US007409176B2

(12) United States Patent
Choi et al.

(10) Patent No.: US 7,409,176 B2
(45) Date of Patent: Aug. 5, 2008

(54) IMAGE FORMING APPARATUS INCLUDING PHOTOSENSITIVE BODY FIXING APPARATUS

(75) Inventors: Dong-ha Choi, Suwon-si (KR); Myung-woo Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/282,616

(22) Filed: Nov. 21, 2005

(65) Prior Publication Data

US 2006/0110182 A1 May 25, 2006

(30) Foreign Application Priority Data

Nov. 22, 2004 (KR) ..... 10-2004-0095905

(51) Int. Cl.
*G03G 21/16* (2006.01)
*G03G 15/00* (2006.01)

(52) U.S. Cl. ..... 399/111; 399/117

(58) Field of Classification Search ..... 399/112, 399/116, 117
See application file for complete search history.

(56) References Cited

U.S. PATENT DOCUMENTS 6,157,797 A * 12/2000 Saito et al. ..... 399/107
6,381,428 B1 * 4/2002 Yamamoto et al. ..... 399/116
6,445,895 B2 * 9/2002 Shirasawa et al. ..... 399/116
6,721,521 B2 * 4/2004 Kataoka et al. ..... 399/112
6,738,590 B2 * 5/2004 Okimura et al. ..... 399/111
2004/0165910 A1 * 8/2004 Sato et al. ..... 399/116

FOREIGN PATENT DOCUMENTS

| | | |
|---|---|---|
| JP | 08-016068 | 1/1996 |
| JP | 2003-177650 | 6/2003 |
| KR | 1990-0007146 | 4/1990 |
| KR | 1994-0013299 | 6/1994 |
| KR | 1998-053449 | 9/1998 |
| KR | 2004-0021315 | 3/2004 |

* cited by examiner

*Primary Examiner*—David M Gray
*Assistant Examiner*—Joseph S. Wong
(74) *Attorney, Agent, or Firm*—Stein, McEwen & Bui, LLP

(57) ABSTRACT

An image forming apparatus including a photosensitive bodies fixing unit. The image forming apparatus includes: a main body frame; a fixing frame on which a plurality of photosensitive bodies are installed, the fixing frame being fixed at a predetermined position on the main body frame; a guide protruding portion formed on the fixing frame to guide the fixing frame to be coupled with the main body frame; a guide rail formed on the main body frame for the guide protruding portion to be inserted into; and a position determining portion formed on the guide rail to fix the guide protruding portion to a predetermined position. Accordingly, the parallel alignment between the scanning units and the photosensitive bodies may be relatively easily maintained and accurate color overlapping and color presentation are obtained to achieve high image quality. Further, the fixing frame may be fixed at a predetermined position by adjusting the tolerance of a part of the position determining portion, and the transfer unit may be integrated with the fixing frame and fixed at a predetermined position on the main body frame.

16 Claims, 7 Drawing Sheets

IMAGE FORMING APPARATUS INCLUDING PHOTOSENSITIVE BODY FIXING APPARATUS

CROSS-REFERENCE TO RELATED APPLICATION

This application claims the benefit of Korean Application No. 2004-95905, filed Nov. 22, 2004 in the Korean Intellectual Property Office, the disclosure of which is incorporated herein by reference.

BACKGROUND OF THE INVENTION

1. Field of the Invention

An aspect of the present invention relates to an image forming apparatus, and, more particularly, to an image forming apparatus including a plurality of photosensitive bodies, scanning units, and a photosensitive body fixing apparatus, in which the photosensitive body fixing apparatus allows assembly tolerances such as the parallel alignment between the photosensitive bodies and the scanning units to be easily adjusted and high image quality may be obtained.

2. Description of the Related Art

An electrophotographic image forming apparatus produces a monochrome image or a color image by forming an electrostatic latent image on a photosensitive body charged to a uniform electrostatic potential by scanning a laser on the photosensitive body, developing the latent image by supplying toner of a predetermined color to the photosensitive body, and transferring and fusing the image to a sheet of paper.

In general, an electrophotographic color image forming apparatus includes one or more scanning units that scan light onto a photosensitive body on which an electrostatic latent image is to be formed, a plurality of developing units that contain toner of different colors, a transferring unit that transfers a developed toner image to a sheet of paper, and a feeding unit that contains and feeds sheets of paper.

Each of the developing units for each color is installed at a predetermined position along a guide surface formed on a main body frame of the image forming apparatus. Each of the scanning units is either assembled into the main body frame or assembled into an individual frame and then integrally installed in the main body frame while being kept parallel to a plurality of photosensitive bodies. The positions of the respective photosensitive bodies may be selected as reference points in assembling the plurality of developing units and scanning units.

When the units are installed in the main body frame, the positions of the developing units, the scanning units and the photosensitive bodies between the scanning units and the developing units must be strictly controlled so as to provide for accurate color overlapping, uniform color representation, and to avoid color banding.

Meanwhile, if each of a plurality of photosensitive bodies is fixed individually to the main body frame, managing assembly tolerances such as the distance between the photosensitive bodies, the parallel alignment between the scanning units and the photosensitive bodies, and the focal length of the light may be difficult. Further, when each of the plurality of photosensitive bodies is removed individually from the main body frame for maintenance, the photosensitive body must be installed at/separated from a predetermined position regardless of the proficiency of an operator or the presence of an assembly jig.

SUMMARY OF THE INVENTION

An aspect of the present invention provides an image forming apparatus that includes a photosensitive body fixing apparatus which fixes a plurality of photosensitive bodies to a fixing frame on which a guide unit is formed such that assembly tolerances may be relatively easily adjusted.

Another aspect of the present invention provides an image forming apparatus that includes a photosensitive body fixing apparatus which allows a plurality of photosensitive bodies and scanning units to be integrated with each other and installed in a main body frame.

According to another aspect of the present invention, there is provided an image forming apparatus comprising: a main body frame; a fixing frame on which a plurality of photosensitive bodies are installed, the fixing frame being fixed at a predetermined position on the main body frame; a guide protruding portion formed on the fixing frame to guide the fixing frame to be coupled with the main body frame; a guide rail formed on the main body frame for the guide protruding portion to be inserted into; and a position determining portion formed on the guide rail to fix the guide protruding portion to a predetermined position. The image forming apparatus may further comprise: a locking member which locks the guide protruding portion to the position determining portion. The guide protruding portion may comprise a main guide protruding portion; and an auxiliary guide protruding portion, and the position determining portion may comprise a main position determining portion that supports the main guide protruding portion at multiple contact points; and an auxiliary position determining portion that supports the auxiliary guide protruding portion at one contact point.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
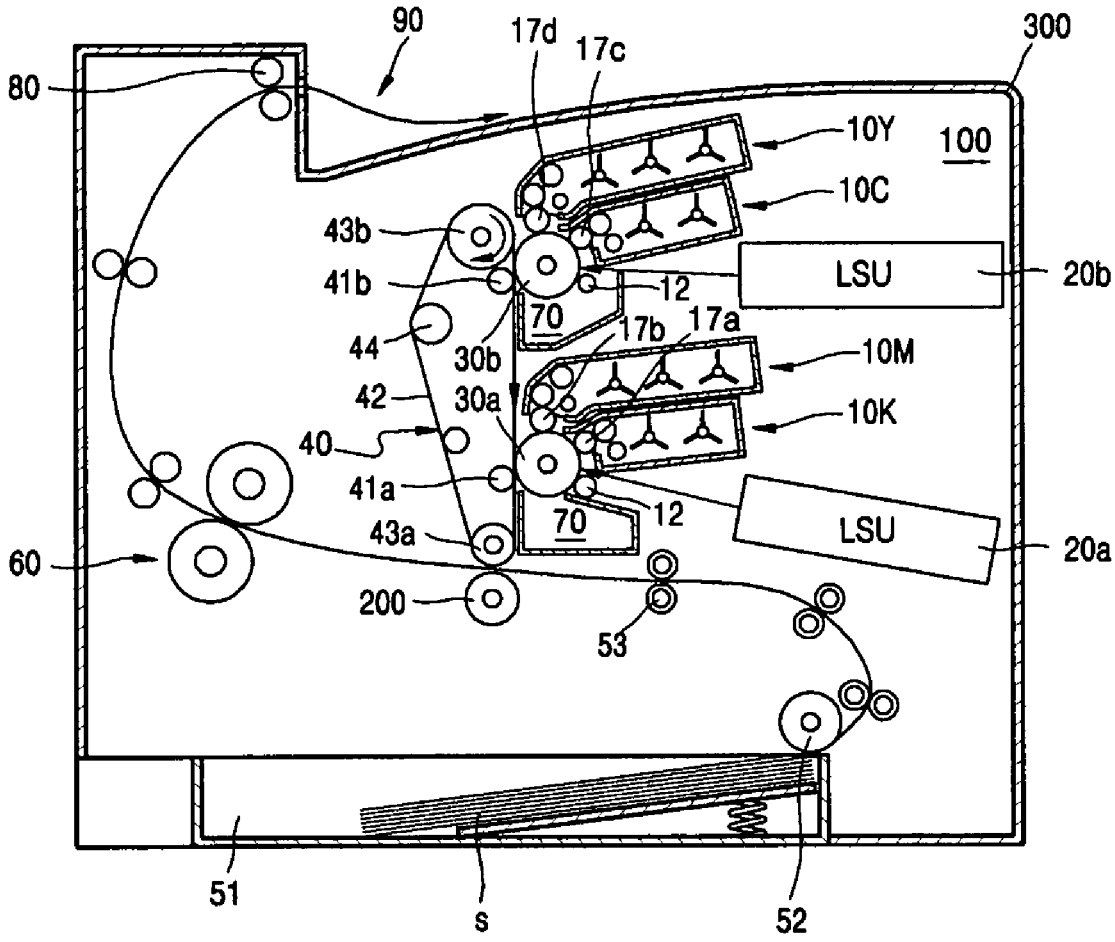
FIG. 1 is a cross-sectional view of an image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Electrophotographic color image forming apparatuses are generally classified into single pass image forming apparatuses that include four scanning units and four photosensitive bodies, four-pass image forming apparatuses that include one scanning unit and one photosensitive body, and two-pass image forming apparatuses that include two scanning units and two photosensitive bodies. Generally, electrophotographic color image forming apparatuses also include four developing units, each containing a different color toner.

With reference to FIG. 1, according to an embodiment of the invention, an image forming apparatus 300, as illustrated in FIG. 1, includes a two-pass print unit 100. The two-pass print unit 100 includes four developing units 10C, 10M, 10Y, 10K, each containing a different color toner, two photosensitive bodies 30*a* and 30*b*, two scanning units 20*a* and 20*b*, a transfer unit 40, and a fusing unit 60.

The developing units 10Y and 10C, which contain yellow (Y) toner and cyan (C) toner, respectively, are disposed around the second photosensitive body 30*b*, and the developing units 10M and 10K, which contain magenta (M) toner and black (K) toner, respectively, are disposed around the first photosensitive body 30*a*. The first photosensitive body 30*a* is disposed near a second transfer roller 200.

The first and second scanning units 20*a* and 20*b* form electrostatic latent images on outer circumferential surfaces of the first and second photosensitive bodies 30*a* and 30*b* respectively by radiating light corresponding to image data of respective cyan (C), yellow (Y), magenta (M), and black (K) colors onto the first and second photosensitive bodies 30*a* and 30*b* according to a computer signal. The first and second scanning units 20*a* and 20*b* are laser scanning units (LSUs). The first and second scanning units 20*a* and 20*b* each comprises a laser diode for use as a light source.

According to an embodiment of the invention, the developing units 10K, 10M, 10C and 10Y are cartridges that are detachably installed, respectively include developing rollers 17*a*, 17*b*, 17*c* and 17*d*, and contain toner to be used in developing operations. More specifically, the developing rollers 17*a* and 17*b* develop a toner image by supplying toner to an electrostatic latent image that is formed on the first photosensitive body 30*a*. Similarly, the developing rollers 17*c* and 17*d* develop a toner image by supplying toner to an electrostatic latent image that is formed on the second photosensitive body 30*b*. A developing bias voltage is applied to each of the developing rollers 17*a*, 17*b*, 17*c* and 17*d* to supply toner to the corresponding one of the first and second photosensitive bodies 30*a* and 30*b*. A toner layer regulating unit (not shown) regulates the height of toner adhered to the outer circumference of each of the developing rollers 17*a*, 17*b*, 17*c* and 17*d*, and friction-charges the toner to a predetermined polarity.

The first and second photosensitive bodies 30*a* and 30*b* are cylinder-shaped metal drums whose outer circumferential surfaces are respectively coated with photoconductive material layers using a deposition method or the like. Each of the first and second photosensitive bodies 30*a* and 30*b* is charged to a predetermined potential by a charger 12. Electrostatic latent images corresponding to a desired image are formed on the outer circumferences of the first and second photosensitive bodies 30*a* and 30*b* by radiating light from the first and second scanning units 20*a* and 20*b* according to a computer signal. The exposed outer circumferences of first and second photosensitive bodies 30*a* and 30*b* face an intermediate transfer belt 42.

The intermediate transfer belt 42 is interposed between the first and second photosensitive bodies 30*a* and 30*b* and the first transfer rollers 41*a* and 41*b* that face the first and second photosensitive bodies 30*a* and 30*b*, respectively. Passing between the first and second photosensitive bodies 30*a* and 30*b* and first transfer rollers 41*a* and 41*b*, the intermediate transfer belt 42 turns while the tension thereof is controlled by a tension roller 44. A transfer bias voltage with a polarity opposite to that of a toner image is applied to the first transfer rollers 41*a* and 41*b* so as to transfer the toner images that are developed on the first and second photosensitive bodies 30*a* and 30*b* to the intermediate transfer belt 42 by an electrostatic force between the first and second photosensitive bodies 30*a* and 30*b* and the first transfer rollers 41*a* and 41*b*.

A second transfer roller 200 is disposed proximate to an intermediate transfer belt driving roller 43*a*. As such, a transfer path through which a sheet of paper S passes is between the second transfer roller 200 and the intermediate transfer belt driving roller 43*a*. A transfer bias voltage with a polarity opposite to the plurality of the toner image is applied so as to transfer the toner image that has been transferred to the intermediate transfer belt 42 onto the sheet of paper S. The toner image is transferred to the sheet of paper S by the electrostatic force between the intermediate transfer belt 42 and the second transfer roller 200.

The fusing unit 60 includes a heat roller and a pressing roller that faces the heat roller. The fusing unit 60 fixes a toner image that is transferred to the sheet of paper S by applying heat and pressure to the sheet of paper S. The heat roller is used as a heat source to tightly fix the toner image. The pressing roller fixes the toner image to the sheet of paper S by applying pressure to the sheet of paper S.

Discharging rollers 80 discharge the sheet of paper S, to which the toner image has been fixed, outside of the image forming apparatus. The discharged sheet of paper S is then stacked on a discharging unit 90.

Hereafter, the operation of the image forming apparatus according to an exemplary embodiment of the present invention will be described in detail.

The second scanning unit 20*b* scans light corresponding to yellow image data onto the second photosensitive body 30*b*, and the first scanning unit 20*a* scans light corresponding to magenta image data onto the first photosensitive body 30*a*. When the light is scanned, static electricity on that part of the photosensitive bodies 30*b* and 30*a*, where the light is scanned, is selectively removed. Then, an electrostatic potential on part of the photosensitive bodies 30*a* and 30*b* where the light is scanned is lowered. Due to the potential difference, the electrostatic latent image is formed on the photosensitive bodies 30*a* and 30*b*.

When the electrostatic latent image approaches the developing unit 10Y as the second photosensitive body 30*b* rotates, the developer roller 17*d* of the developing unit 10Y starts rotating. The rotation of the developing unit 10Y allows the yellow toner to be adhered to the electrostatic latent image formed on the outer circumference of the second photosensitive body 30*b*. As a result, a yellow (Y) toner image is formed on the second photosensitive body 30*b*.

When the yellow (Y) toner image, which is formed on the second photosensitive body 30*b*, approaches the intermediate transfer belt 42, the yellow (Y) toner image is transferred to the intermediate transfer belt 42 due to the transfer bias voltage of the first transfer roller 41*b*.

While the yellow (Y) toner image is being transferred to the intermediate transfer belt 42, the intermediate transfer belt 42 continues to travel toward the first photosensitive body 30*a*. A magenta (M) toner image is formed on an outer circumference of the first photosensitive body 30*a* in the same fashion as described above, and the magenta (M) toner image formed on the outer circumference of the first photosensitive body 30*a* is transferred to the intermediate transfer belt 42 so as to overlap with the yellow (Y) toner image.

Thus, following a single rotation of the intermediate transfer belt 42, the yellow (Y) and magenta (M) toner images are completely transferred to the intermediate transfer belt 42.

Cyan (C) and black (K) toner images are transferred to the intermediate transfer belt 42 in a substantially similar manner as that which is described above. When all of the yellow (Y), magenta (M), cyan (C), and black (K) toner images are transferred to the intermediate transfer belt 42 in an overlapping manner, the color toner images are transferred to the sheet of paper S.

Of course, it is understood that the order in which the differently colored toner images are transferred to the intermediate transfer belt 42 as described above (i.e., yellow, then magenta, then cyan and black) may be changed and/or modified as desired or as is necessary.

A paper feeding unit includes the paper feeding cassette 51 and a feed roller 52. The paper feeding cassette 51 contains sheets of paper. The sheet of paper S is drawn out from a paper feeding cassette 51 by a feed roller 52. In greater detail, the feed roller 52 picks up sheets of paper one by one from the paper feeding cassette 51 and draws them out sequentially. The sheet of paper S is registered by a resist roller 53 and passes between the intermediate transfer belt driving roller 43*a* and the second transfer roller 200. Again, in greater detail, before the sheet of paper S passes between the intermediate transfer belt driving roller 43*a* and the second transfer roller 200, the resist roller 53 aligns the sheet of paper S such that the color toner image may be transferred onto a desired position of the sheet of paper S. A front end of the sheet of paper S and a front end of the color toner image formed on the intermediate transfer belt 42 substantially synchronously arrive at a contact point of the intermediate transfer belt driving roller 43*a* and second transfer roller 200. When the sheet of paper S passes between the intermediate transfer belt 42 and the second transfer roller 200, the color toner image formed on the intermediate transfer belt 42 is transferred to the sheet of paper S due to a transfer bias voltage applied to the second transfer roller 200. The sheet of paper S sequentially moves from the paper feeding cassette 51, to the feed roller 52, to the second transfer roller 200, to the fusing unit 60, and to the discharging roller 80.

To remove a paper jam that may occur due to abnormal operation in the image forming apparatus according to the present embodiment, the transfer unit 40 and a photosensitive unit (i.e. the photosensitive bodies 30*a* and 30*b*) are upwardly separated from the image forming apparatus 300 by a user so as to expose the moving path of the sheet of paper S. The developing unit (i.e. the developing units 10Y, 10C, 10M and 10K) is separated from the image forming apparatus in a horizontal direction so as to expose the moving path of the sheet of paper S. When the moving path of the sheet of paper S is exposed, the paper jam may be relatively easily removed. To this end, a fixing frame, on which the transfer unit 40 and the photosensitive bodies 30*a* and 30*b* are mounted, is assembled/separated vertically in the image forming apparatus.

Although the two-pass type print unit 100 has been described in the present embodiment, the present invention is not limited thereto, and various types of electrophotographic print units to print an image may be employed by the present invention.

Figure 2:
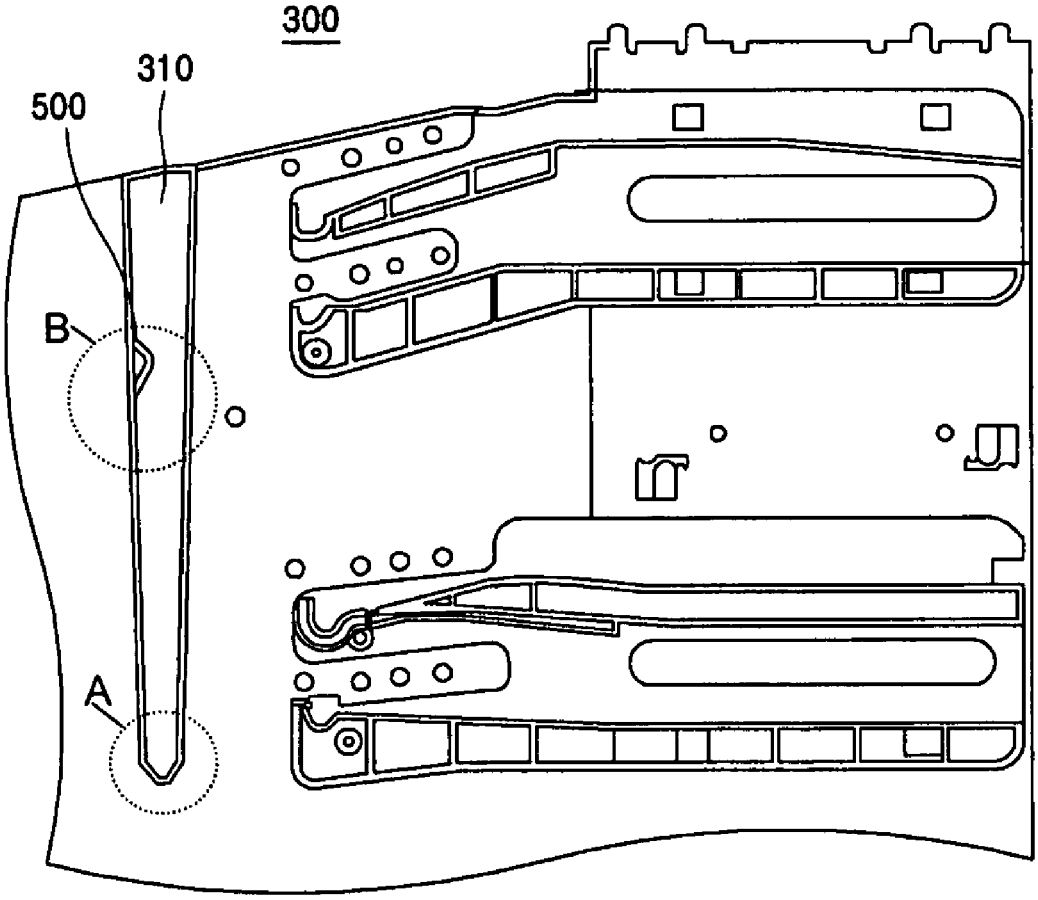
FIG. 2 is a side view of a main body frame of the image forming apparatus illustrated in FIG. 1.
Figure 3:
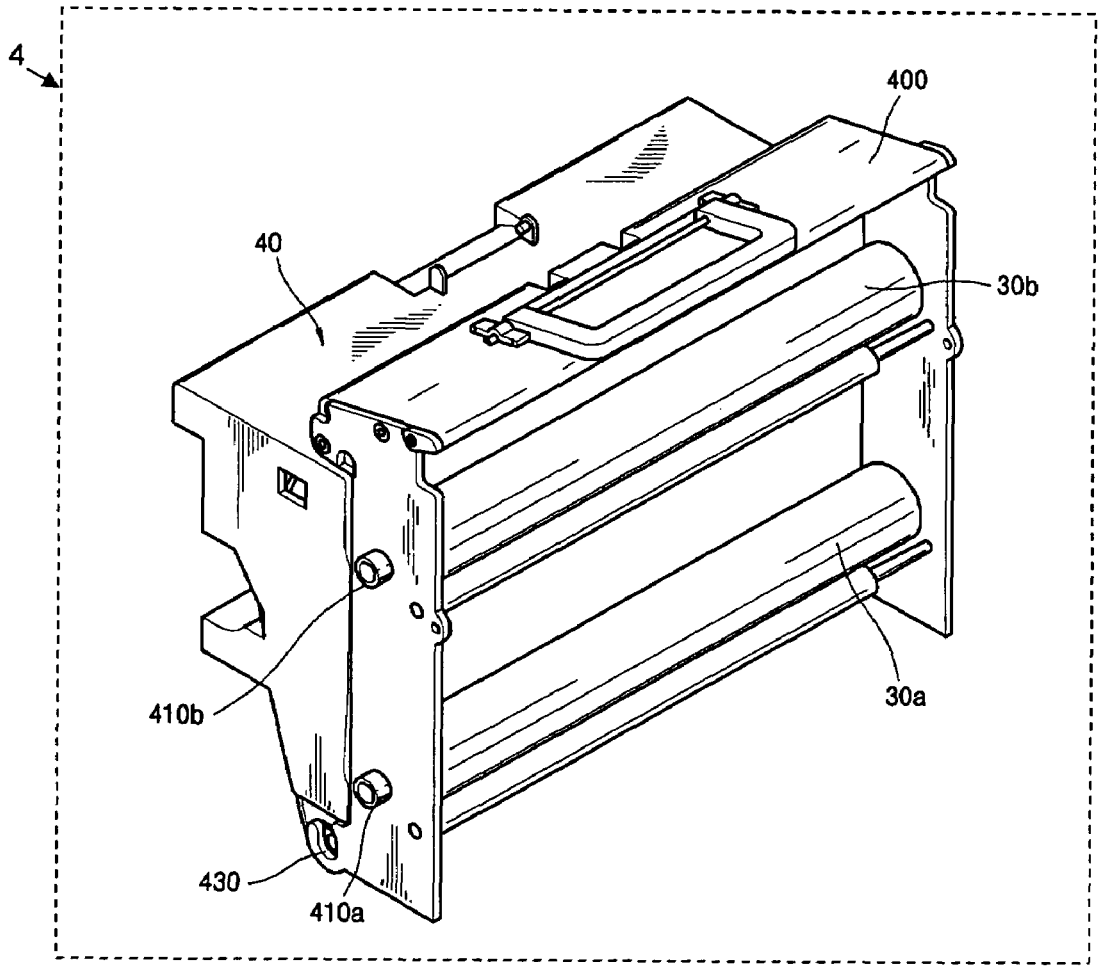
FIG. 3 is a perspective view of a fixing frame coupled with a transfer unit illustrated in FIG. 2.
Figure 4:
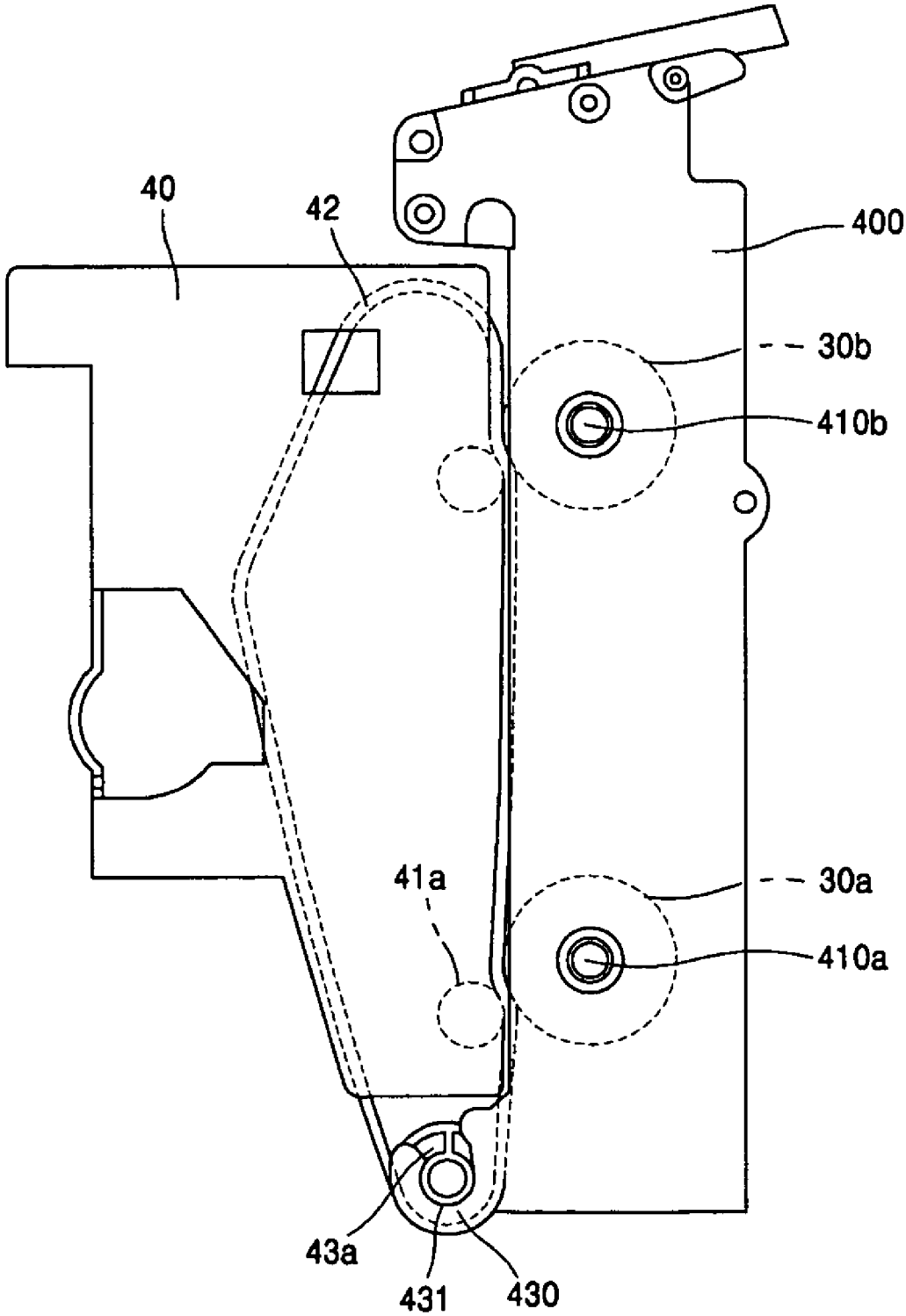
FIG. 4 is a side view of the fixing frame coupled with the transfer unit illustrated in FIG. 3.
Figure 5:
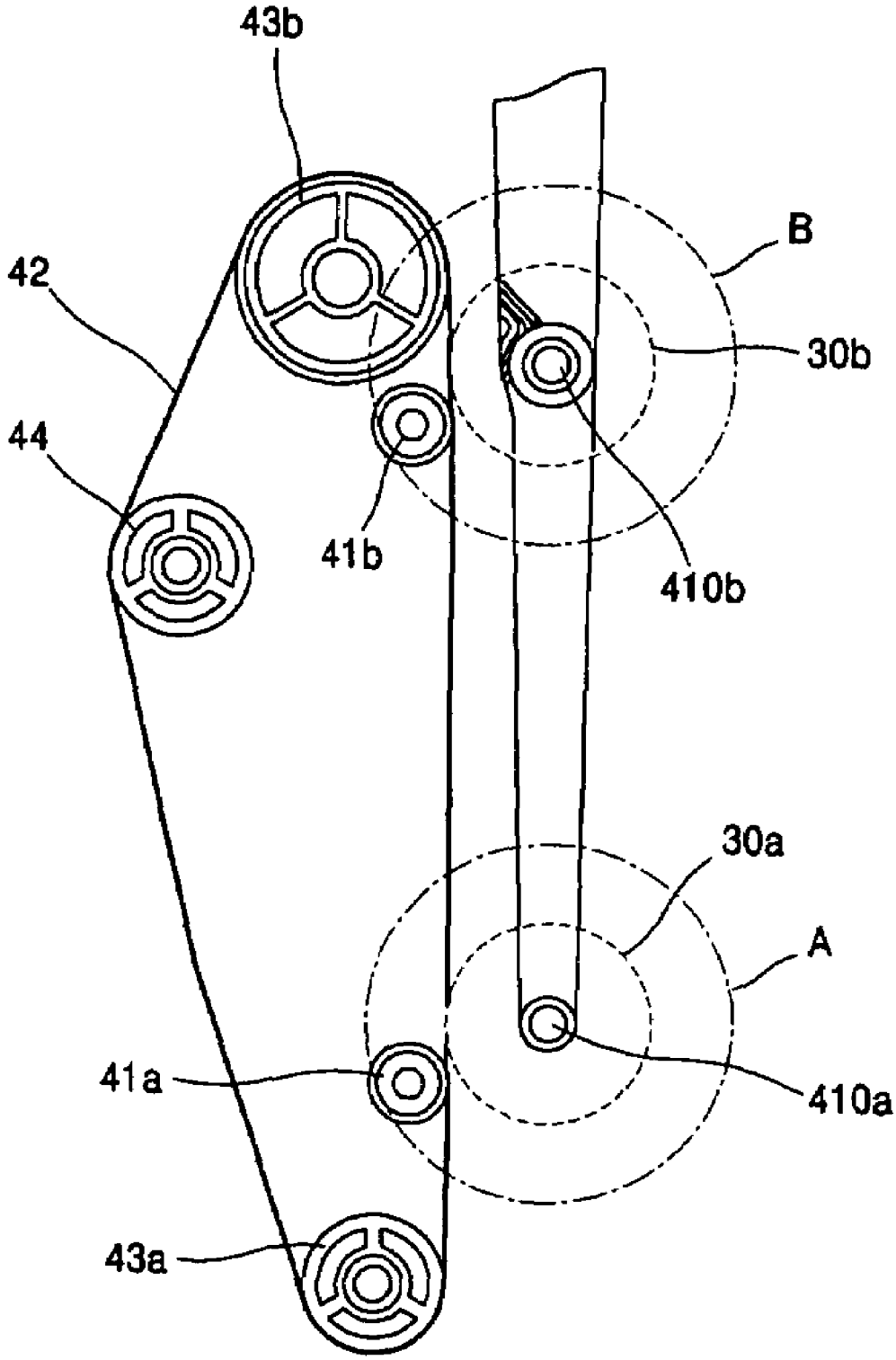
FIG. 5 is a side view for explaining the relationship between guide protruding portions and a guide rail of the image forming apparatus illustrated in FIG. 1.

FIG. 2 is a side view of a main body frame 300 of the image forming apparatus shown in FIG. 1. FIG. 3 is a perspective view of the fixing frame 400 coupled with the transfer unit 40 according to the present embodiment, and FIG. 4 is a side view of the fixing frame 400 coupled with the transfer unit 40 of FIG. 3. FIG. 5 is a view to explain the relationship between the guide protruding portions 410*a* and 410*b* and the guide rail 310.

With reference to FIGS. 2 and 3, and according to an exemplary embodiment of the present invention, one end of a guide rail 310, which extends vertically, is open to the upper side of the main body frame 300, and the bottom end of the guide rail 310 is tapered. Therefore, the fixing frame 400 may be separated upwardly from and installed downwardly in the main body frame 300.

An image forming apparatus according to another embodiment of the present invention includes a photosensitive body fixing apparatus 4. The photosensitive body fixing apparatus 4 includes the fixing frame 400, in which the first and second photosensitive bodies 30*a* and 30*b* are installed a predetermined distance apart, guide protruding portions 410*a* and 410*b*, the guide rail 310 formed in the main body frame 300 to receive the guide protruding portions 410*a* and 410*b*, and position determining portions formed on the guide rail 310, which will be described later.

Referring to FIGS. 2 and 3, the guide rail 310 is formed inside the main body frame 300, and the fixing frame 400, in which the first and second photosensitive bodies 30*a* and 30*b* are installed, is inserted into the guide rail 310. The guide rail 310 includes a locking member 500 and a position determining portion thereof that fixes the fixing frame 400 in a predetermined position of the main body frame 300 and which, as noted above, will be described later.

Since a plurality of photosensitive bodies 30*a* and 30*b* are integrated with each other and installed in the fixing frame 400, the assembly tolerance between the plurality of photosensitive bodies 30*a* and 30*b* may be adjusted while the photosensitive bodies 30*a* and 30*b* are installed in the fixing frame 400. When, as in an embodiment of the invention, the photosensitive bodies 30*a* and 30*b* are cartridges that are installed in the fixing frame 400 and mounted within the main body frame 300, the assembly tolerance of the photosensitive bodies 30*a* and 30*b* may be relatively easily controlled and the user convenience is higher than the case where the photosensitive bodies 30*a* and 30*b* are individually assembled in the main body frame 300.

The guide protruding portions 410*a* and 410*b*, as illustrated in FIG. 3, are formed on both sides of the fixing frame 400. According to an exemplary embodiment of the present invention, the guide protruding portions 410*a* and 410*b* are respectively formed at the ends of the rotation axes of the photosensitive bodies 30*a* and 30*b* that protrude to the both sides of the fixing frame 400. Further, if the guide protruding portions 410*a* and 410*b* are respectively concentric with the rotation axes of the photosensitive bodies 30*a* and 30*b* such that the center coordinates of the guide protruding portions 410*a* and 410*b* are substantially identical to the center coordinates of the photosensitive bodies 30*a* and 30*b*, respectively, the assembly tolerance of these features may be relatively easily adjusted. However, the present invention is not limited to this embodiment, and it is understood that the guide protruding portions 410*a* and 410*b* may be formed anywhere on the sides of the fixing frame 400 regardless of the axes of the photosensitive bodies 30*a* and 30*b*.

According to an embodiment of the invention, the guide protruding portions 410*a* and 410*b* act as a main guide protruding portion 410*a* and an auxiliary guide protruding portion 410*b*, respectively. The guide rail 310 of the main body frame 300 includes the position determining portion, as discussed above and as illustrated in FIGS. 6 and 7, which includes a main position determining portion 600 and an auxiliary position determining portion 700 which may only be seen in full detail in FIG. 7.

Figure 6:
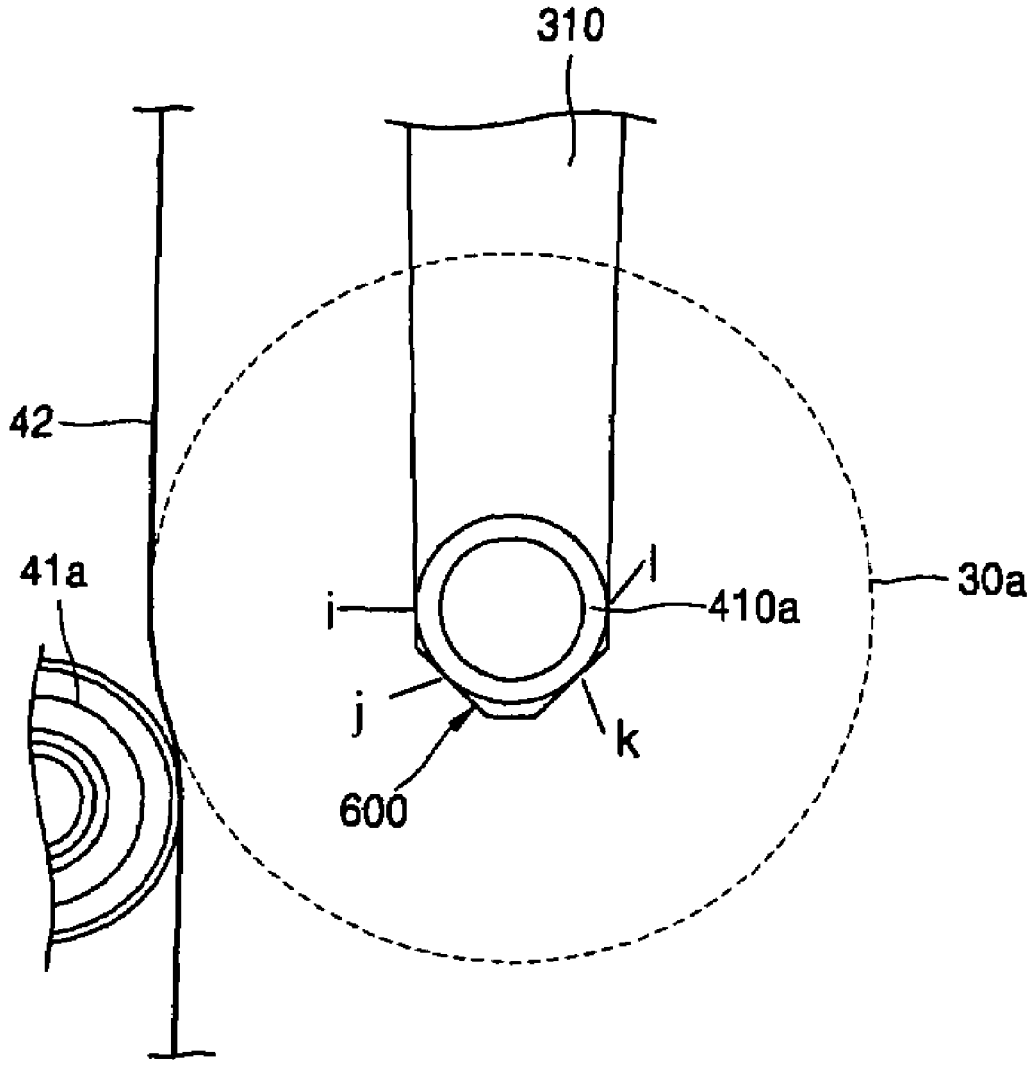
FIG. 6 is a detailed side view of a part A of FIGS. 2 and 5.

As illustrated in FIG. 6, the main position determining portion 600 must be shaped such that the main position determining portion 600 contacts the main guide protruding portion 410*a* at two or more contact points and supports the main guide protruding portion 410*a* at a plurality of contact points. Indeed, as illustrated in FIG. 6, the main guide protruding portion 410*a* has a cylindrical shape, and the main position determining portion 600 includes both sides of the guide rail 310 and a V-shaped end portion of the guide rail 310. Such a structure of the main position determining portion 600, therefore, provides support to the main guide protruding portion 410*a* at four points (i, j, k and l).

Figure 7:
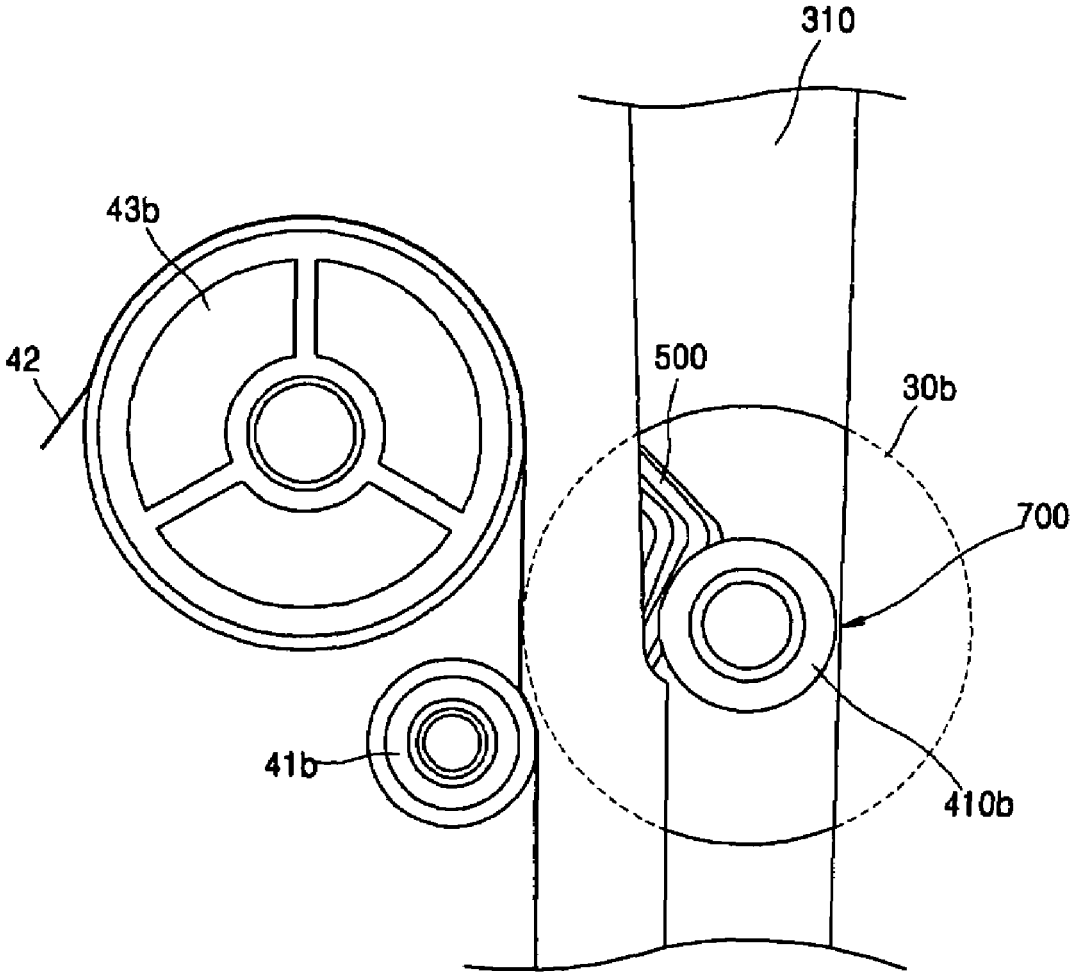
FIG. 7 is a detailed side view of a part B of FIGS. 2 and 5.

As illustrated in FIG. 7, when the auxiliary guide protruding portion 410*b* is inserted into the guide rail 310, the auxiliary guide protruding portion 410*b* contacts one side of the guide rail 310. The auxiliary position determining portion 700 is formed at one side of the guide rail 310 that contacts the auxiliary guide protruding portion 410*b* at one point.

When the installation location of the fixing frame 400 is determined in two perpendicular axes, the main position determining portion 600 determines the installation location of one end of the fixing frame 400 in two axes, the auxiliary position determining portion 700 determines the installation location of the other end of the fixing frame 400 in one axis, and a locking member 500 applies pressure to the position determining portion to determine the installation locations of both end of the fixing frame 400 in two axes.

When the locking member 500 does not apply pressure to the position determining portion, the auxiliary guide protruding portion 410*b* rotates about the main guide protruding portion 410*a* in a gap between both sides of the guide rail 310. Even when the tolerance of the whole surface of the guide rail 310 is not entirely adjusted, if the tolerance of the main position determining portion 600 and auxiliary position determining portion 700 is particularly adjusted, the fixing frame 400 may be fixed in a correct position.

Thus, as illustrated in FIG. 7, the auxiliary guide protruding portion 410*b* has a cylindrical shape, and the auxiliary position determining portion 700 includes a surface of the guide rail 310 that contacts the auxiliary guide protruding portion 410*b* to support the auxiliary guide protruding portion 410*b* at one point. The point of contact is the point where the one surface of the guide rail 310 supports one hand of the auxiliary guide protruding portion 410*b*.

The locking member 500 is installed on one side of the guide rail 310 and locks the auxiliary guide protruding portion 410*b* in the position determining portion by supporting another hand of the auxiliary guide protruding portion 410*b*. For this reason, the locking member 500 may be an elastic member that applies a force to the auxiliary guide protruding portion 410*b* toward the main position determining portion 600 and the auxiliary position determining portion 700.

The fixing frame 400 on which a plurality of photosensitive bodies 30*a* and 30*b* are installed is inserted into the guide rail 310 and fixed at a predetermined position by the position determining portion including the main position determining portion 600 and the auxiliary position determining portion 700. The main guide protruding portion 410*a* must not contact the locking member 500 so as to avoid interfering with the locking member 500 as the main guide protruding portion 410*a* is guided to the main position determining portion 600. To this end, the outer diameter of the main guide protruding portion 410*a* may be smaller than the outer diameter of the auxiliary guide protruding portion 410*b* such that the main guide protruding portion 410*a* may easily pass through a gap between the auxiliary guide protruding portion and the locking member 500.

As discussed above, the transfer unit 40 transfers the toner image developed on the photosensitive body onto the intermediate transfer belt 42. The intermediate transfer belt 42 is disposed between the first transfer rollers 41*a* and 41*b* and the photosensitive bodies 30*a* and 30*b*, and the first transfer rollers 41*a* and 41*b* and the photosensitive bodies 30*a* and 30*b* face each other while maintaining a predetermined nip therebetween. For accurate operation of the transfer unit 40, a predetermined assembly tolerance level between the transfer unit 40 and each of the photosensitive bodies 30*a* and 30*b* must be maintained. Therefore, it is understood that if the transfer unit 40 were able to be inserted in and/or separated from the main body frame 300 together with the fixing frame 400 when the fixing frame 400 is inserted in/separated from the main body frame 300, adjusting the assembly tolerance of these features to the predetermined level is possible.

As such, the photosensitive body fixing apparatus 4 includes a transfer unit connecting portion 430 where the transfer unit 40 is coupled with the fixing frame 400 to fix the transfer unit 40 at a predetermined position of the main body frame 300. According to an embodiment of the invention and as illustrated in FIGS. 3 and 4, the transfer unit connecting portion 430 is a C-shaped connection groove 431 formed on one end portion of the fixing frame 400. One end of the transfer unit 40 is rotatably connected to the connection groove 431, or may be separated from an opening portion of the connection groove 431.

According to aspects of the present invention described above, an image forming apparatus including a photosensitive body fixing apparatus 4 may obtain the effects that are described below. First, a plurality of photosensitive bodies are integrally installed a predetermined distance apart in a fixing frame and the fixing frame is assembled in a main body frame on which scanning units are mounted. Thus, parallel alignment between the scanning units and the photosensitive bodies may be relatively easily maintained and accurate color overlapping and color presentation are obtained so as to achieve high image quality. Second, the fixing frame is installed and/or separated using a simple element such as a locking member without a need for an individual assembling apparatus. Further, the fixing frame is fixed at a predetermined position by managing the tolerance of only part of a surface of a position determining portion, not the entire surface of a guide rail. Therefore, productivity and user convenience are improved. Third, a transfer unit may be relatively easily fixed at a predetermined position of the main body frame while being integrated with the fixing frame. Finally, the photosensitive bodies and the transfer unit are inserted and/or separated vertically in the image forming apparatus. Thus, removing jammed paper and maintenance of the various features of the image forming apparatus is relatively easy.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a main body;

a fixing frame, in which a plurality of photosensitive bodies are installed, the fixing frame being inserted into and/or removed from a fixed position in the main body;

main and auxiliary guide protruding portions formed on the fixing frame to guide the fixing frame as the fixing frame is inserted into and/or removed from the main body;

a guide rail, formed in the main body, to receive the guide protruding portions; and main and auxiliary position determining portions, formed at an end of the guide rail and along a first side of the guide rail, respectively, to correspond to positions of the guide protruding portions, the main guide protruding portion being fixed at the main position determining portion and the auxiliary guide protruding portion being biased against a second side of the guide rail at the auxiliary position determining portion, wherein an outer diameter of the auxiliary guide protruding portion is greater than an outer diameter of the main guide protruding portion.

2. The image forming apparatus of claim 1, further comprising:

a locking member which locks the guide protruding portions in the position determining portions.

3. The image forming apparatus of claim 2, wherein the main guide protruding portion is located at a first location of the fixing frame and the auxiliary guide protruding portion is located at a second location of the fixing frame which is disposed a predetermined distance from the first location.

4. The image forming apparatus of claim 3, wherein the main guide protruding portion is supported at multiple contact points at the main position determining portion when the fixing frame is inserted into the main body and the auxiliary guide protruding portion is supported at one contact point at the auxiliary position determining portion when the fixing frame is inserted into the main body.

5. The image forming apparatus of claim 4, wherein the auxiliary guide protruding portion has a cylindrical shape, and the auxiliary position determining portion includes a surface to contact and support the auxiliary guide protruding portion at one contact point.

6. The image forming apparatus of claim 4, wherein the locking member is an elastic member that applies pressure to the auxiliary guide protruding portion toward the main position determining portion and the auxiliary position determining portion.

7. The image forming apparatus of claim 4, wherein the image forming apparatus is a two-pass image forming apparatus in which two photosensitive bodies are installed on the fixing frame.

8. The image forming apparatus of claim 1, further comprising:

a transfer unit which transfers a toner image developed on the photosensitive bodies, wherein the transfer unit is coupled with the fixing frame and fixed at a predetermined position in the main body frame.

9. The image forming apparatus of claim 8, wherein one end of the transfer unit is rotatably connected to a C-shaped connection groove formed on one end of the fixing frame or separated from an opening portion of the C-shaped connection groove.

10. The image forming apparatus of claim 8, wherein the image forming apparatus is a two-pass image forming apparatus in which two photosensitive bodies are installed on the fixing frame.

11. The apparatus according to claim 1, wherein the guide rail comprises:

a first end which extends vertically and which is open to the upper side of the main body; and a second end which is inwardly tapered.

12. The apparatus according to claim 11, wherein the guide rail further comprises a locking member to fix the auxiliary guide protruding portion against the second side the guide rail.

13. The image forming apparatus of claim 1, wherein the guide protruding portions are centered about rotation axes of the photosensitive bodies, respectively, on both sides of the fixing frame.

14. The apparatus according to claim 1, wherein the outer diameter of the auxiliary guide protruding portion is greater than a width of the end of the guide rail.

15. An image forming apparatus comprising:

a main body;

a fixing frame, in which a plurality of photosensitive bodies are installed, the fixing frame being removably inserted into the main body;

a guide protruding portion formed on the fixing frame to guide the fixing frame to be coupled with the main body;

a guide rail, formed in the main body, to receive the guide protruding portion;

a position determining portion formed on the guide rail to fix the guide protruding portion, including a main position determining portion that supports the main guide protruding portion at multiple contact points and an auxiliary position determining portion that supports the auxiliary guide protruding portion at one contact point; and a locking member which locks the guide protruding portion to the position determining portion, wherein the guide protruding portion comprises a main guide protruding portion, at a first location of the fixing frame, and an auxiliary guide protruding portion, at a second location of the fixing frame which is disposed a predetermined distance from the first location, and wherein the main guide protruding portion has a cylindrical shape, and the main position determining portion includes both sides of the guide rail and V-shaped surfaces at one end of the guide rail to support the main guide protruding portion at four contact points.

16. An image forming apparatus comprising:

a main body;

a fixing frame, in which a plurality of photosensitive bodies are installed, the fixing frame being removably inserted into the main body;

a guide protruding portion formed on the fixing frame to guide the fixing frame to be coupled with the main body;

a guide rail, formed in the main body, to receive the guide protruding portion;

a position determining portion formed on the guide rail to fix the guide protruding portion, including a main position determining portion that supports the main guide protruding portion at multiple contact points and an auxiliary position determining portion that supports the auxiliary guide protruding portion at one contact point; and a locking member which locks the guide protruding portion to the position determining portion, wherein the guide protruding portion comprises a main guide protruding portion, at a first location of the fixing frame, and an auxiliary guide protruding portion, at a second location of the fixing frame which is disposed a predetermined distance from the first location, wherein the locking member is an elastic member that applies pressure to the auxiliary guide protruding portion toward the main position determining portion and the auxiliary position determining portion, and wherein an outer diameter of the main guide protruding portion is smaller than the outer diameter of the auxiliary guide protruding portion such that the main guide protruding portion passes relatively easily through a gap between the auxiliary guide protruding portion and the locking member.

* * * * *